US006019868A

United States Patent [19]

Kimura et al.

[11] Patent Number: 6,019,868

[45] Date of Patent: Feb. 1, 2000

[54] POLISHING APPARATUS

[75] Inventors: Norio Kimura; Hozumi Yasuda, both of Fujisawa, Japan

[73] Assignee: Ebara Corporation, Tokyo, Japan

[21] Appl. No.: 09/028,661

[22] Filed: Feb. 24, 1998

[30] Foreign Application Priority Data

Feb. 27, 1997 [JP] Japan ..... 9-059933

[51] Int. Cl.[7] ..... B24B 37/00

[52] U.S. Cl. ..... 156/345; 451/287; 451/288; 451/41

[58] Field of Search ..... 156/345; 451/41, 451/287, 288

[56] References Cited

U.S. PATENT DOCUMENTS

| | | | |
|---|---|---|---|
| 5,441,444 | 8/1995 | Nakajima . | |
| 5,476,414 | 12/1995 | Hirose et al. | 451/288 |
| 5,584,751 | 12/1996 | Kobayashi et al. . | |
| 5,795,215 | 8/1998 | Guthrie et al. | 451/286 |

FOREIGN PATENT DOCUMENTS

| | | |
|---|---|---|
| 0 548 846 | 6/1993 | European Pat. Off. . |
| 08290358A | 11/1996 | Japan . |

OTHER PUBLICATIONS

U.S. Patent Application No. 08/728,069, filed Oct. 9, 1996, entitled "Apparatus For And Method Of Polishing Workpiece", by Masamichi Nakashiba.

U.S. Patent Application No. 08/728,070, filed Oct. 9, 1996, entitled "Apparatus For And Method Of Polishing Workpiece", by Norio Kimura.

*Primary Examiner*—Richard Bueker
*Assistant Examiner*—Shamim Ahmed
*Attorney, Agent, or Firm*—Wenderoth, Lind & Ponack, L.L.P.

[57] ABSTRACT

A polishing apparatus for polishing a workpiece to a flat mirror finish includes a turntable with a polishing cloth attached to an upper surface thereof, and a top ring for holding a workpiece thereon and pressing the workpiece against the polishing cloth to polish the workpiece. A retainer ring or a presser ring is disposed around the top ring. The retainer ring or the presser ring is vertically movable independently of the top ring, and pressed against the polishing cloth by a pressing mechanism. A stabilizing mechanism is disposed between an inner circumferential surface of the retainer ring or the presser ring, and an outer circumferential surface of the top ring, for holding the top ring substantially stabilized within the retainer ring or the presser ring.

12 Claims, 10 Drawing Sheets

POLISHING APPARATUS

BACKGROUND OF THE INVENTION

1. Field of the Invention

The present invention relates to a polishing apparatus for polishing a workpiece such as a semiconductor wafer to a flat mirror finish, and more particularly to a polishing apparatus having a workpiece carrier, i.e., a top ring which is tiltable so as to follow undulation or surface irregularities of a polishing surface on a turntable.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small. Conventionally, as apparatuses for planarizing semiconductor wafers, there have been used a self-planarizing CVD apparatus, an etching apparatus or the like, however, these apparatuses fail to fully planarize semiconductor wafers. Recently, attempts have been made to use a polishing apparatus for planarizing semiconductor wafers to a flatter finish with more ease than those conventional planarizing apparatus.

Conventionally, a polishing apparatus has a turntable and a top ring which rotate at respective individual speeds. A polishing cloth is attached to the upper surface of the turntable. A semiconductor wafer to be polished is placed on the polishing cloth and clamped between the top ring and the turntable. An abrasive liquid containing abrasive grains is supplied onto the polishing cloth and retained on the polishing cloth. During operation, the top ring exerts a certain pressure on the turntable, and the surface of the semiconductor wafer held against the polishing cloth is therefore polished by a combination of chemical polishing and mechanical polishing to a flat mirror finish while the top ring and the turntable are rotated. This process is called Chemical Mechanical polishing.

If the semiconductor wafer is not pressed against the polishing cloth under forces which are uniform over the entire surface of the semiconductor wafer, then the semiconductor wafer tends to be polished insufficiently or excessively in local areas depending on the applied forces. The following arrangements have been proposed in the art to prevent the semiconductor wafer from being pressed against the polishing cloth under irregular forces.

1) One conventional solution has been to apply an elastic pad of polyurethane or the like to a workpiece holding surface of the top ring for uniformizing a pressing force applied from the top ring to the semiconductor wafer.

2) According to another solution, the top ring, i.e., a workpiece carrier for holding a semiconductor wafer is tiltable with respect to the surface of the polishing cloth.

3) Still another attempt has been to press a region of the polishing cloth surrounding the semiconductor wafer, independently of the semiconductor wafer, for thereby eliminating an appreciable step between a region of the polishing cloth pressed by the semiconductor wafer and the surrounding region thereof.

FIG. 8 of the accompanying drawings shows a conventional polishing apparatus. As shown in FIG. 8, the conventional polishing apparatus generally comprises a turntable 5 with a polishing cloth 6 attached to an upper surface thereof, a top ring 1 for holding a semiconductor wafer 4 to be polished and pressing the semiconductor wafer 4 against the polishing cloth 6, and an abrasive liquid supply nozzle 25 for supplying an abrasive liquid Q to the polishing cloth 6. The top ring 1 is connected to a top ring shaft 8 and has an elastic pad 2 of polyurethane or the like attached to its lower surface. The semiconductor wafer 4 is held by the top ring 1 in contact with the elastic pad 2. The top ring 1 also has a cylindrical retainer ring 3 mounted on an outer circumferential edge thereof for preventing the semiconductor wafer 4 from being disengaged from the lower surface of the top ring 1. The retainer ring 3 has a lower end projecting downwardly from the lower surface of the top ring 1 for holding the semiconductor wafer 4 on the elastic pad 2 against disengagement from the top ring 1 under frictional engagement with the polishing cloth 6 during a polishing process.

In operation, the semiconductor wafer 4 is held against the lower surface of the elastic pad 2 which is attached to the lower surface of the top ring 1. The semiconductor wafer 4 is then pressed against the polishing cloth 6 on the turntable 5 by the top ring 1, and the turntable 5 and the top ring 1 are rotated independently of each other to move the polishing cloth 6 and the semiconductor wafer 4 relatively to each other, thereby polishing the semiconductor wafer 4. The abrasive liquid Q comprises an alkaline solution containing abrasive grains of the fine particles suspended therein, for example. The semiconductor wafer 4 is polished by a composite action comprising a chemical polishing action of the alkaline solution and a mechanical polishing action of the abrasive grains.

A spherical bearing 7 is slidingly interposed between the upper end surface of the top ring 1 and a lower end surface of the top ring shaft 8 which rotates the top ring 1. Specifically, the lower end surface of the top ring shaft 8 has a semispherical recess 8*a* defined centrally therein, and the upper end surface of the top ring 1 has a semispherical recess 1*b* defined centrally therein. The spherical bearing 7 is slidingly received in the semispherical recesses 8*a* and 1*b*. Even if the upper surface of the turntable 5 is slightly inclined, the top ring 1 is tilted with respect to the top ring shaft 8 by the spherical bearing 7. The top ring shaft 8 has a plurality of torque transmitting pins 107 extending radially outwardly and held in point-to-point contact with a plurality of respective torque transmitting pins 108 projecting upwardly from the upper end surface of the top ring 1. Therefore, even when the top ring 1 is tilted, the torque can reliably be transmitted from the top ring shaft 8 to the top ring 1 through the point-to-point contact between the torque transmitting pins 107 and 108.

FIG. 9 of the accompanying drawings shows a polishing apparatus which has been proposed by the applicant of the present invention in Japanese patent application No. 7-287976. As shown in FIG. 9, a semiconductor wafer 4 is held by a top ring 1 and pressed against a polishing cloth 6 on a turntable 5. The semiconductor wafer 4 is retained on the top ring 1 by a cylindrical retainer ring 3 which is disposed around and connected to the top ring 1 by keys 18. The keys 18 allow the retainer ring 3 to move vertically with respect to the top ring 1 and to rotate together with the top ring 1. The retainer ring 3 is rotatably supported by a bearing 19 which is held by a bearing holder 20 operatively coupled by a plurality of (e.g. three) circumferentially spaced shafts 21 to a plurality of (e.g. three) circumferentially spaced retainer ring air cylinders 22. The retainer ring air cylinders 22 are fixedly mounted on a top ring head 9. The top ring 1 has an upper surface held in sliding contact with a spherical bearing 7 that is slidably supported on the lower end of a top ring shaft 8. The top ring shaft 8 is rotatably supported by the top ring head 9. The top ring 1 is vertically movable by a top ring air cylinder 10 mounted on the top ring head 9 and operatively connected to the top ring shaft 8.

The top ring air cylinder 10 and the retainer ring air cylinders 22 are connected to a compressed air source 24 respectively through regulators R1 and R2. The regulator R1 regulates the air pressure supplied from the compressed air source 24 to the top ring air cylinder 10 to adjust the pressing force for pressing the semiconductor wafer 4 against the polishing cloth 6 by the top ring 1. The regulator R2 regulates the air pressure supplied from the compressed air source 24 to the retainer ring air cylinders 22 to adjust the pressing force for pressing the retainer ring 3 against the polishing cloth 6. By adjusting the pressing force of the retainer ring 3 with respect to the pressing force of the top ring 1, the distribution of polishing pressures is made continuous and uniform from the center of the semiconductor wafer 4 to its peripheral edge and further to the outer circumferential edge of the retainer ring 3 disposed around the semiconductor wafer 4. Consequently, the peripheral portion of the semiconductor wafer 4 is prevented from being polished excessively or insufficiently. The semiconductor wafer 4 can thus be polished to a high quality and with a high yield.

FIG. 10 of the accompanying drawings illustrates the states of the semiconductor wafer 4, the polishing cloth 6, and the elastic pad 2 while the semiconductor wafer 4 is being polished by a conventional polishing apparatus. When only the semiconductor wafer 4 is pressed against the polishing cloth 6, the peripheral portion of the semiconductor wafer 4 is positioned at a boundary between contact and noncontact with the polishing cloth 6 and also at a boundary between contact and noncontact with the elastic pad 2. Therefore, at the peripheral portion of the semiconductor wafer 4, the polishing pressure applied to the semiconductor wafer 4 by the polishing cloth 6 and the elastic pad 2 is not uniform, thus the peripheral portion of the semiconductor wafer 4 is liable to be polished to an excessive degree. As a result, the peripheral edge of the semiconductor wafer 4 is often polished into an edge-rounding. The polishing apparatus shown in FIG. 9 is effective to reduce the excessive polishing of the peripheral edge of the semiconductor wafer 4 because the retainer ring 3 is pressed against the polishing cloth 6 around the semiconductor wafer 4, independently of the top ring 1.

Another proposed retainer ring comprises an annular weight vertically movably disposed around the top ring for pressing the polishing cloth by its own weight.

In the conventional polishing apparatus, and also the polishing apparatus shown in FIG. 9, which has been proposed in Japanese patent application No. 7-287976, the top ring is tiltable to keep the surface to be polished of the semiconductor wafer parallel to the polishing cloth even if the polishing cloth has undulations or other surface irregularities. The top ring is made tiltable by a spherical cup bearing or a ball slidably interposed between the top ring and the top ring shaft. One problem of the tiltable top ring is that the top ring may be tilted excessively due to smooth sliding motion, and cannot be kept in parallel to the polishing cloth 6. In other words, the tiltable top ring cannot be stably held in its desirable posture with respect to the polishing cloth.

The above problem will be described in detail below with reference to FIG. 11 of the accompanying drawings. In FIG. 11, the top ring 1 is pressed against the polishing cloth 6 under a pressing force $F_1$, and the retainer ring 3 is pressed downwardly substantially parallel against an upper surface 6*a* of the polishing cloth 6 under a pressing force $F_2$ by the retainer ring air cylinders 22. The top ring 1, which is positioned inside of the retainer ring 3, is tiltable with respect to the polishing cloth 6 by the spherical bearing 7 slidably interposed between the top ring shaft 8 and the top ring 1. When the semiconductor wafer 4 held by the top ring 1 is polished, the top ring 1 is liable to be tilted due to frictional forces between the lower surface of the semiconductor wafer 4 and the upper surface 6*a* of the polishing cloth 6. If the top ring 1 is excessively tilted out of parallelism with the polishing cloth 6, then the semiconductor wafer 4 held on the top ring 1 cannot be polished to a flat mirror finish.

SUMMARY OF THE INVENTION

It is therefore an object of the present invention to provide a polishing apparatus in which a workpiece carrier, i.e., a top ring is tiltable so as to follow undulations or surface irregularities of a polishing cloth on a turntable and the top ring is prevented from being excessively tilted with respect to the polishing cloth.

According to one aspect of the present invention, there is provided an apparatus for polishing a workpiece, comprising: a turntable with a polishing cloth mounted on an upper surface thereof; a top ring for holding a workpiece and pressing the workpiece against the polishing cloth under a first pressing force to polish the workpiece; a retainer ring positioned outwardly of the top ring for retaining the workpiece on the top ring, the retainer ring being vertically movable relative to the top ring; and a stabilizing mechanism disposed between an inner circumferential surface of the retainer ring and an outer circumferential surface of the top ring, for holding the top ring substantially stabilized within the retainer ring.

According to another aspect of the present invention, there is provided an apparatus for polishing a workpiece, the apparatus comprising: a turntable with a polishing cloth mounted on an upper surface thereof; a top ring for holding a workpiece and pressing the workpiece against the polishing cloth under a first pressing force to polish the workpiece, the top ring having a retaining portion for retaining an outer circumferential edge of the workpiece; a presser ring positioned outwardly of the retaining portion, the presser ring being vertically movable relative to the top ring; and a stabilizing mechanism disposed between an inner circumferential surface of the presser ring and an outer circumferential surface of the top ring, for holding the top ring substantially stabilized within the presser ring.

The stabilizing mechanism may comprise a plurality of rollers rotatably supported on the inner circumferential surface of the retainer ring or the presser ring and held in rolling contact with the outer circumferential surface of the top ring for preventing the top ring from being excessively tilted within the retainer ring or the presser ring.

Alternatively, the stabilizing mechanism may comprise a resilient member supported on the inner circumferential surface of the retainer ring or the presser ring and held in contact with the outer circumferential surface of the top ring for preventing the top ring from being excessively tilted within the retainer ring or the presser ring.

The stabilizing mechanism is disposed on the inner circumferential surface of the retainer ring or the presser ring and held in engagement with the outer circumferential surface of the top ring. The stabilizing mechanism comprises rollers or a resilient member such as an O-ring of rubber or the like. The rollers or the resilient member on the inner circumferential surface of the retainer ring or the presser ring is held in contact with the outer circumferential surface of the top ring for thereby holding the top ring substantially angularly stabilized within the retainer ring or the presser ring. Even when the top ring is subjected to forces which tend to tilt the top ring due to frictional contact between the workpiece held by the top ring and the polishing cloth while the workpiece is being polished, the surface of the top ring which holds the workpiece is prevented from being excessively tilted and is maintained substantially parallel to the surface of the polishing cloth. Further, the stabilizing mechanism serves to stabilize the unstable top ring in cooperation with the retainer ring or the presser ring which is stable. The stabilizing mechanism may allow the retainer ring or the presser ring to move vertically with respect to the top ring, or may allow only the top ring to rotate, with the retainer ring or the presser ring being nonrotatable.

The above and other objects, features, and advantages of the present invention will become more apparent from the following description when taken in conjunction with the accompanying drawings in which a preferred embodiments of the present invention is shown by way of illustrative example.

DETAILED DESCRIPTION OF THE PREFERRED EMBODIMENTS

Figure 1:
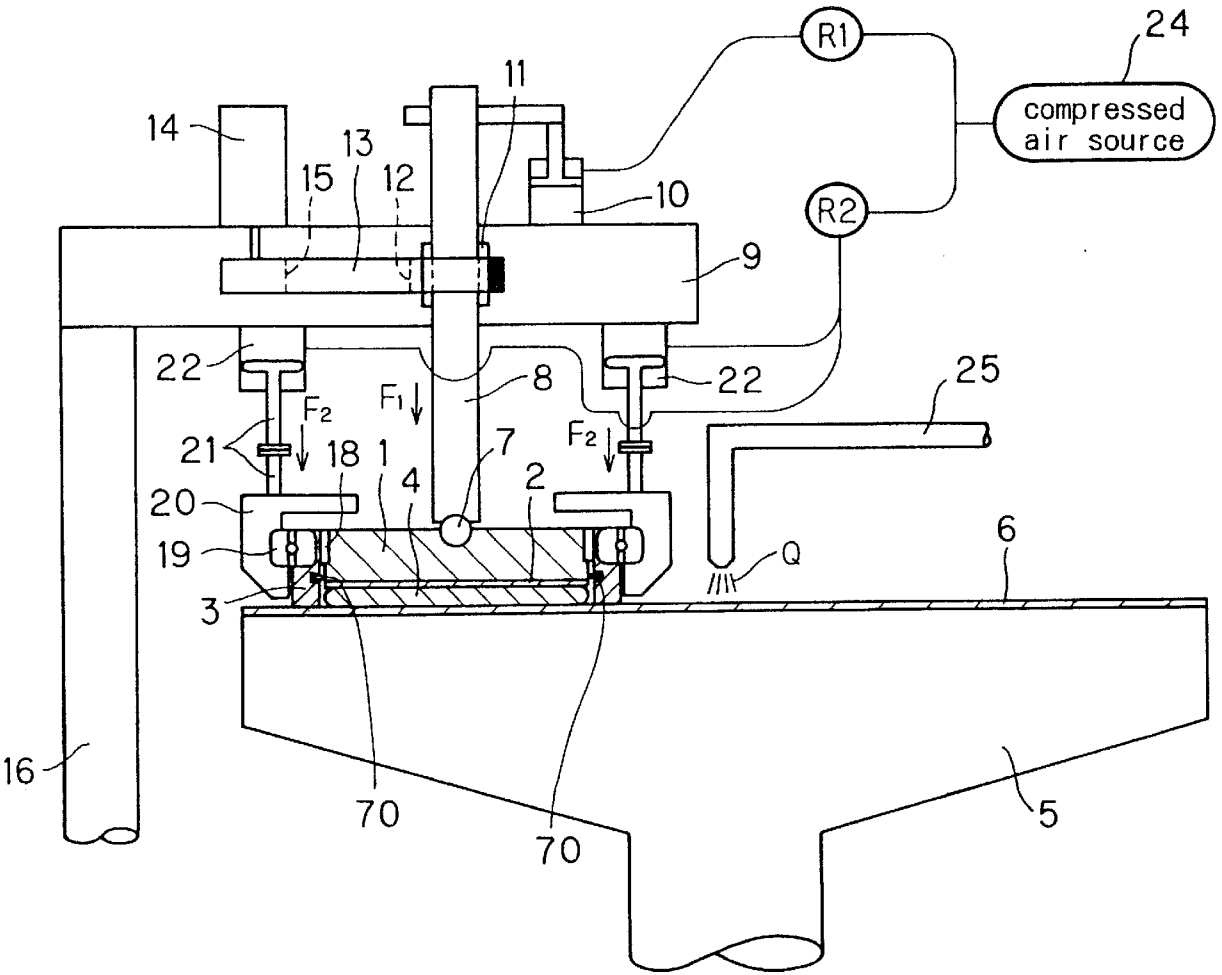
FIG. 1 is a vertical cross-sectional view of a polishing apparatus according to a first embodiment of the present invention.

Next, a polishing apparatus according to embodiments of the present invention will be described below with reference to the drawings. Like or corresponding parts are denoted by like or corresponding reference numerals throughout views.

Figure 2:
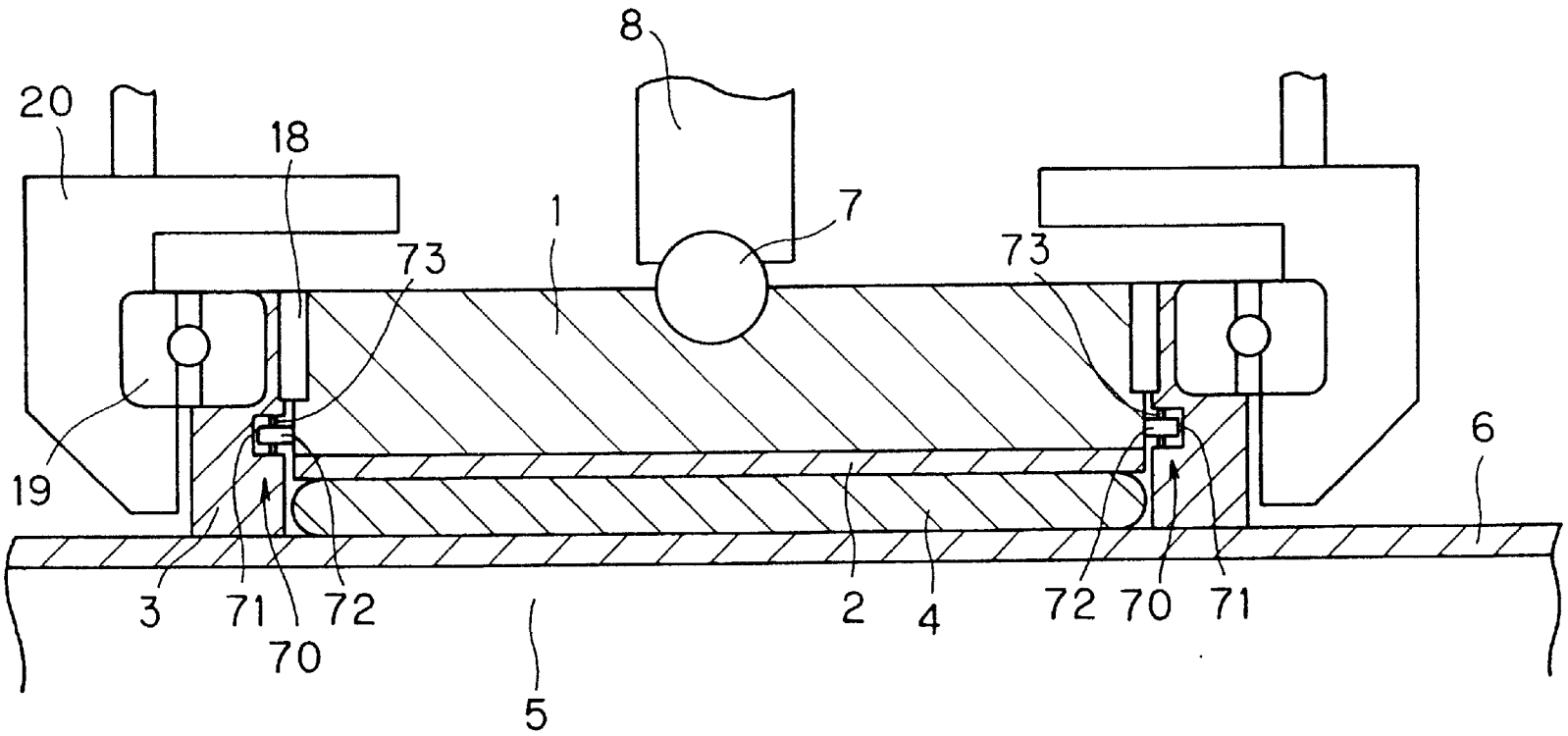
FIG. 2 is an enlarged fragmentary vertical cross-sectional view of the polishing apparatus shown in FIG. 1.

FIGS. 1 and 2 show a polishing apparatus according to a first embodiment of the present invention.

As shown in FIGS. 1 and 2, a top ring 1 has a lower surface for supporting a semiconductor wafer 4 thereon which is a workpiece to be polished. An elastic pad 2 of polyurethane or the like is attached to the lower surface of the top ring 1. A retainer ring 3 is disposed around the top ring 1 and vertically movable with respect to the top ring 1. A turntable 5 with a polishing cloth 6 attached to an upper surface thereof is disposed below the top ring 1. The polishing cloth 6 constitutes a polishing surface of the turntable 5.

The top ring 1 is connected to a vertical top ring shaft 8 whose lower end is held against a ball 7 mounted on an upper surface of the top ring 1. The top ring shaft 8 is operatively coupled to a top ring air cylinder 10 fixedly mounted on an upper portion of a top ring head 9. The top ring shaft 8 is vertically movable by the top ring air cylinder 10 to press the semiconductor wafer 4 supported on the elastic pad 2 against the polishing cloth 6 on the turntable 5.

The top ring shaft 8 has an intermediate portion extending through and corotatably coupled to a rotatable cylinder 11 by a key (not shown), and the rotatable cylinder 11 has a pulley 12 mounted on an outer circumferential surface thereof. The pulley 12 is operatively connected by a timing belt 13 to a timing pulley 15 mounted on the rotatable shaft of a top ring motor 14 which is fixedly mounted on the top ring head 9. Therefore, when the top ring motor 14 is energized, the rotatable cylinder 11 and the top ring shaft 8 are integrally rotated through the timing pulley 15, the timing belt 13 and the timing pulley 12. Thus the top ring 1 is rotated. The top ring head 9 is supported by a top ring head shaft 16 which is vertically fixed on a frame (not shown).

The retainer ring 3 is corotatably, but vertically movably, coupled to the top ring 1 by keys 18. The retainer ring 3 is rotatably supported by a bearing 19 which is mounted on a bearing holder 20. The bearing holder 20 is connected by vertical shafts 21 to a plurality of (three in this embodiment) circumferentially spaced retainer ring air cylinders 22. The retainer ring air cylinders 22 are secured to a lower portion of the top ring head 9.

The top ring air cylinder 10 and the retainer ring air cylinders 22 are pneumatically connected to a compressed air source 24 through regulators R1 and R2, respectively. The regulator R1 regulates an air pressure supplied from the compressed air source 24 to the top ring air cylinder 10 to adjust the pressing force which is applied by the top ring 1 to press the semiconductor wafer 4 against the polishing cloth 6. The regulator R2 also regulates the air pressure supplied from the compressed air source 24 to the retainer ring air cylinder 22 to adjust the pressing force which is applied by the retainer ring 3 to press the polishing cloth 6. The regulators R1 and R2 are controlled by a controller (not shown in FIG. 1).

An abrasive liquid supply nozzle 25 is positioned above the turntable 5 for supplying an abrasive liquid Q onto the polishing cloth 6 on the turntable 5.

The polishing apparatus shown in FIGS. 1 and 2 operates as follows: The semiconductor wafer 4 to be polished is held under the top ring against the elastic pad 2, and the top ring air cylinder 10 is actuated to lower the top ring 1 toward the turntable 5 until the semiconductor wafer 4 is pressed against the polishing cloth 6 on the upper surface of the rotating turntable 5. The top ring 1 and the retainer ring 3 are rotated by the top ring motor 14 through the top ring shaft 8. Since the abrasive liquid Q is supplied onto the polishing cloth 6 by the abrasive liquid supply nozzle 25, the abrasive liquid Q is retained on the polishing cloth 6. Therefore, the lower surface of the semiconductor wafer 4 is polished with the abrasive liquid Q which is present between the lower surface of the semiconductor wafer 4 and the polishing cloth 6.

Depending on the pressing force applied by the top ring 1 actuated by the top ring air cylinder 10, the pressing force applied to the polishing cloth 6 by the retainer ring 3 actuated by the retainer ring air cylinders 22 is adjusted while the semiconductor wafer 4 is being polished. During the polishing process, the pressing force $F_1$ (see FIG. 1) which is applied by the top ring 1 to press the semiconductor wafer 4 against the polishing cloth 6 can be adjusted by the regulator R1, and the pressing force $F_2$ which is applied by the retainer ring 3 to press the polishing cloth 6 can be adjusted by the regulator R2. Therefore, during the polishing process, the pressing force $F_2$ applied by the retainer ring 3 to press the polishing cloth 6 can be changed depending on the pressing force $F_1$ applied by the top ring 1 to press the semiconductor wafer 4 against the polishing cloth 6. By adjusting the pressing force $F_2$ with respect to the pressing force $F_1$, the distribution of polishing pressures is made continuous and uniform from the center of the semiconductor wafer 4 to its peripheral edge and further to the outer circumferential edge of the retainer ring 3 disposed around the semiconductor wafer 4. Consequently, the peripheral portion of the semiconductor wafer 4 is prevented from being polished excessively or insufficiently. The semiconductor wafer 4 can thus be polished to a high quality and with a high yield.

If a greater or smaller thickness of material is to be removed from the peripheral portion of the semiconductor wafer 4 than from the inner region of the semiconductor wafer 4, then the pressing force $F_2$ applied by the retainer ring 3 is selected to be of a suitable value based on the pressing force $F_1$ applied by the top ring 1 to intentionally increase or reduce the amount of a material removed from the peripheral portion of the semiconductor wafer 4.

A mechanism for suppressing tilting of the top ring 1 (hereinafter referred to as a tilt suppressing mechanism 70) is disposed in the inner circumferential surface of the retainer ring 3 and held in engagement with the outer circumferential surface of the top ring 1. The tilt suppressing mechanism 70 constitutes a stabilizing mechanism and serves to prevent the top ring 1 from being tilted excessively with respect to the top ring shaft 8 and hence the polishing cloth 6. The top ring air cylinder 10 applies the downward force $F_1$, through the ball bearing 7 on the lower end of the top ring shaft 8. The top ring 1 is tiltable about the ball bearing 7 within a small gap provided between the outer circumferential surface of the top ring 1 and the inner circumferential surface of the retainer ring 3. While the semiconductor wafer 4 is being polished, the top ring 1 is subject to horizontal frictional forces due to frictional contact between the semiconductor wafer 4 and the polishing cloth 6, and tends to be tilted about the ball bearing 7 under a moment caused by such horizontal frictional force. The tilt suppressing mechanism 70 acts between the outer circumferential surface of the top ring 1 and the inner circumferential surface of the retainer ring 3, for keeping a predetermined gap therebetween to hold the top ring 1 substantially angularly stabilized within the retainer ring 3, thus preventing the top ring 1 from being excessively tilted, i.e., holding the top ring 1 substantially horizontally.

FIG. 2 shows the tilt suppressing mechanism 70 in detail. The retainer ring 3 has an annular recess 71 defined in the inner circumferential surface thereof. The tilt suppressing mechanism 70 comprises a plurality of (e.g. six) rollers 72 rotatably disposed in the annular recess 71 by respective shafts 73. The rollers 72 are held in rolling contact with the outer circumferential surface of the top ring 1 to hold the top ring 1 substantially angularly stabilized within the retainer ring 3. The rollers 72 are circumferentially spaced at suitable angular intervals around the top ring 1 for thereby preventing the top ring 1 from being excessively tilted about the ball bearing 7. Consequently, even under frictional force between the semiconductor wafer 4 and the polishing cloth 6, the lower surface of the retainer ring 3 and the lower end surface of the top ring 1 which holds the semiconductor wafer 4 are kept substantially parallel to the upper surface of the polishing cloth 6. Further, the tilt suppressing mechanism 70 serves to stabilize the unstable top ring 1 in cooperation with the retainer ring 3. That is, even when the top ring 1 is slightly vibrated, the tilt suppressing mechanism 70 damps the vibration of the top ring 1. The rollers 72 are preferably made of synthetic resin such as nylon, polyethylene or polypropylene.

Figure 3:
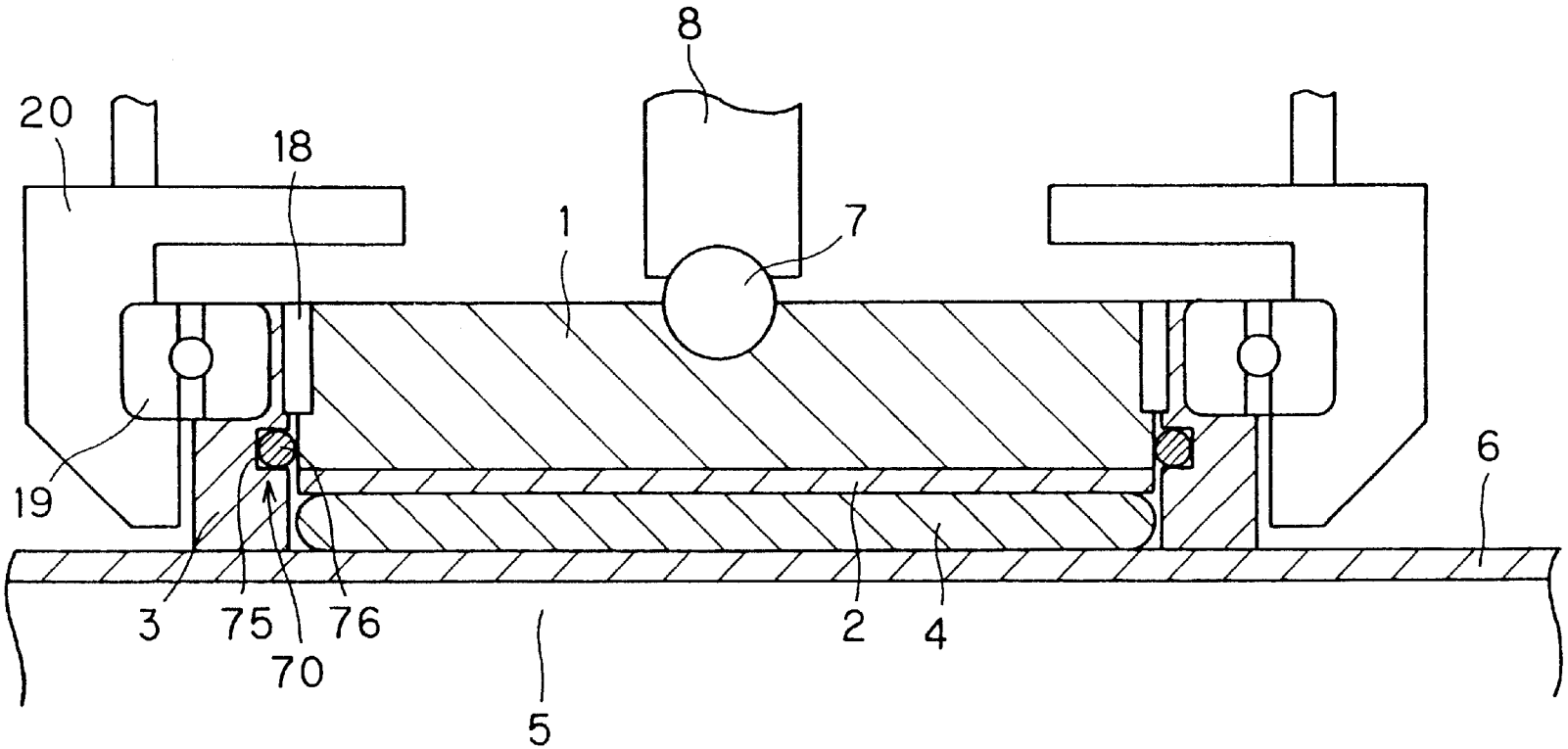
FIG. 3 is an enlarged fragmentary vertical cross-sectional view of a modification of the polishing apparatus shown in FIG. 1.

FIG. 3 shows a modified tilt suppressing mechanism 70 in detail. As shown in FIG. 3, a retainer ring 3 has an annular recess 75 defined in the inner circumferential surface thereof. The modified tilt suppressing mechanism 70 comprises a resilient ring 76 such as an O ring of rubber fitted in the annular recess 75. The resilient ring 76 projects radially inwardly from the inner circumferential surface of the retainer ring 3 into contact with the outer circumferential surface of a top ring 1 to hold the top ring 1 substantially angularly stabilized within the retainer ring 3. Since the outer circumferential surface of the top ring 1 is resiliently secured with respect to the retainer ring 3 by the resilient ring 76, the top ring 1 is prevented from being excessively tilted, and hence is kept substantially parallel to the polishing cloth 6 even under frictional forces between the semiconductor wafer 4 and the polishing cloth 6.

The tilt suppressing mechanism according to the present invention is required to secure the outer circumferential surface of the top ring 1 to the inner circumferential surface of the retainer ring 3 while at the same time allowing the top ring 1 and the retainer ring 3 to move vertically with respect to each other and also allowing the top ring 1 to rotate in unison with the retainer ring 3. Insofar as this requirement is met, the tilt suppressing mechanism is not limited to the rollers 72 or the resilient ring 76, but may comprise any of various other elements.

Figure 4:
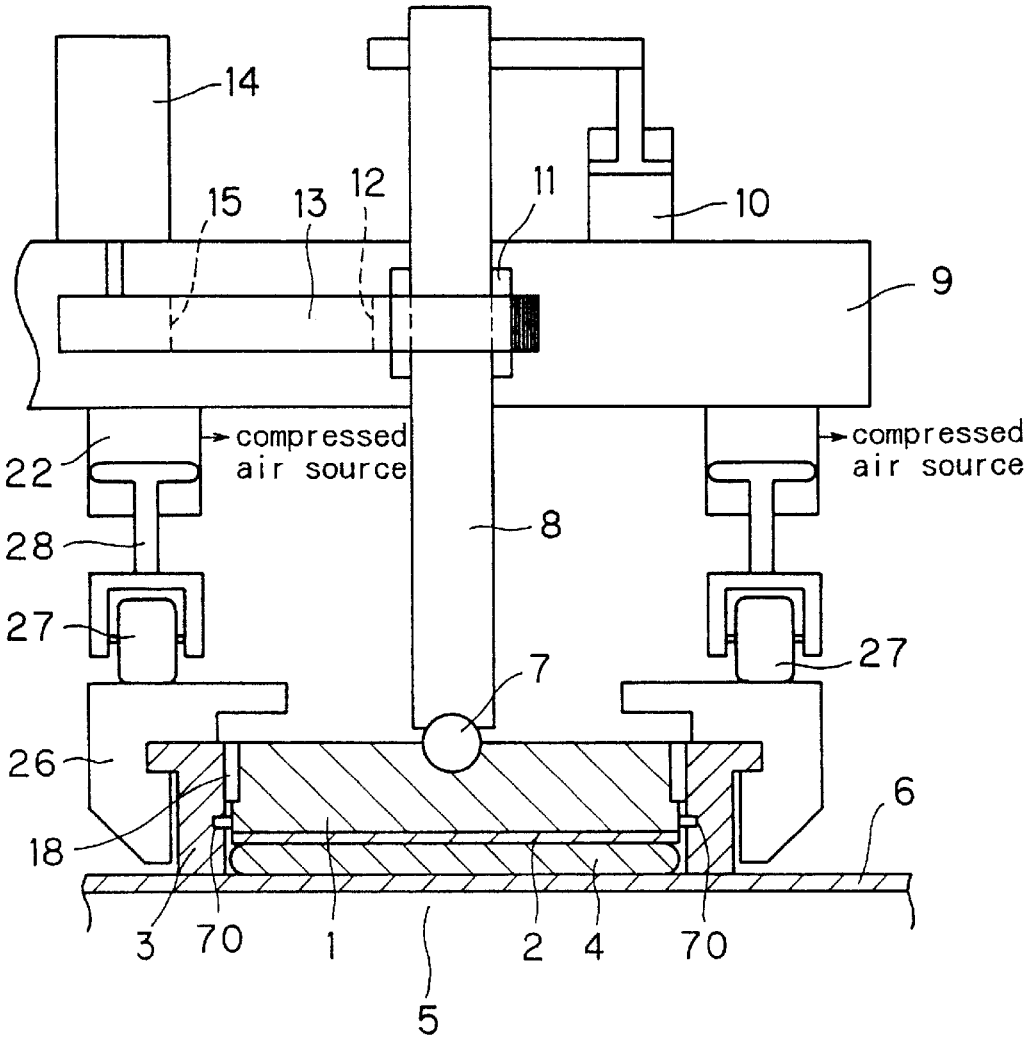
FIG. 4 is a vertical cross-sectional view of a polishing apparatus according to a second embodiment of the present invention.

FIG. 4 shows a polishing apparatus according to a second embodiment of the present invention.

As shown in FIG. 4, the retainer ring 3 disposed around the top ring 1 is held by a retainer ring holder 26 which can be pressed downwardly by a plurality of rollers 27. The rollers 27 are rotatably supported by respective shafts 28 which are connected to the respective retainer ring air cylinders 22 fixed to the lower portion of the top ring head 9. The retainer ring 3 is vertically movable with respect to the top ring 1, and rotatable in unison with the top ring 1, by keys 18 as with the first embodiment shown in FIGS. 1 and 2.

In operation, while the top ring 1 and the retainer ring 3 are rotated, the rollers 27 are rotated about their own axis while the rollers 27 are in rolling contact with the retainer ring holder 26. At this time, the retainer ring 3 is pressed downwardly by the rollers 27, which are lowered by the retainer ring air cylinders 22, thereby pressing the polishing cloth 6 under a given pressure. The polishing apparatus has a tilt suppressing mechanism 70 for holding the top ring 1 substantially angularly stabilized within the retainer ring 3 to prevent the top ring 1 from being excessively tilted. The tilt suppressing mechanism 70 preferably comprises a resilient member such as an O ring of rubber or the like as the top ring 1 and the retainer ring 3 are rotatable.

Figure 5:
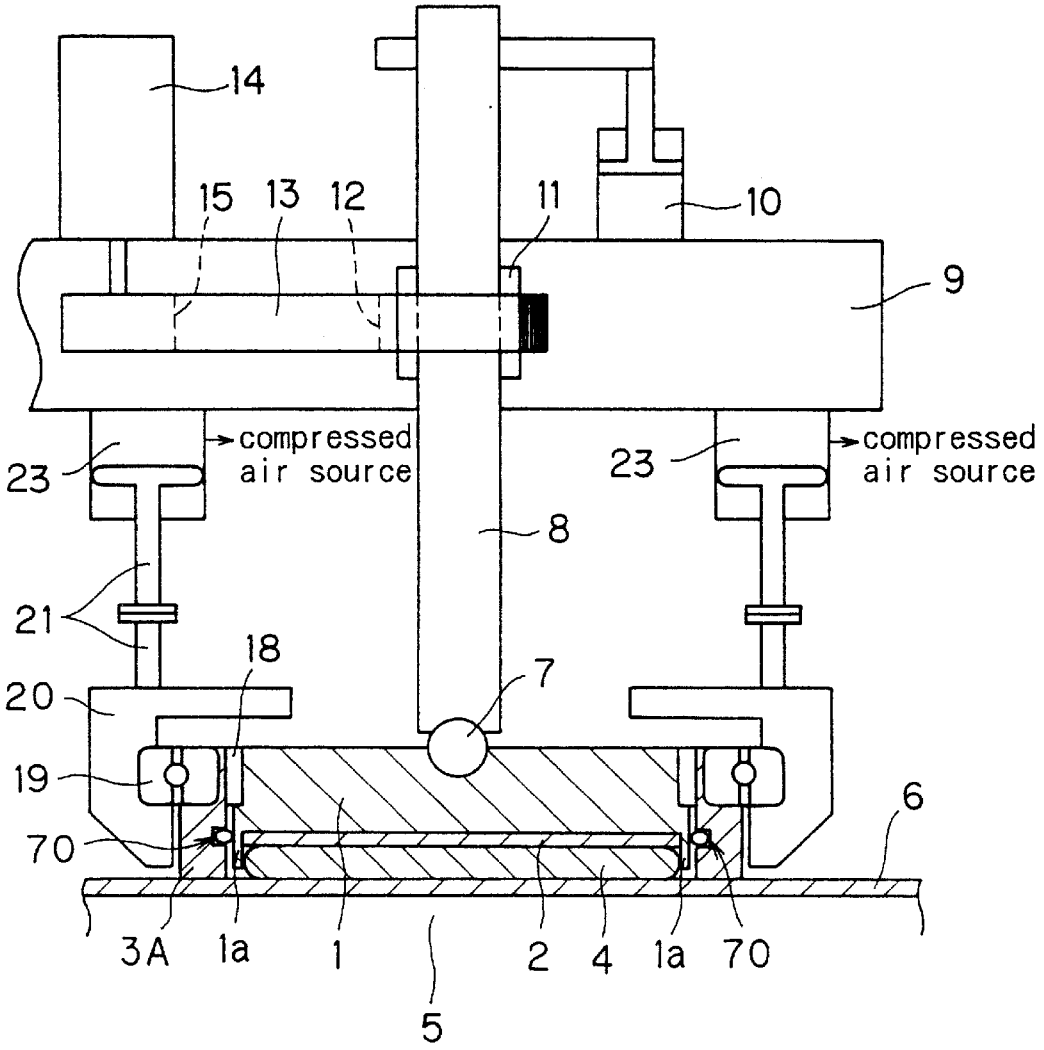
FIG. 5 is a vertical cross-sectional view of a polishing apparatus according to a third embodiment of the present invention.

FIG. 5 shows a polishing apparatus according to a third embodiment of the present invention.

As shown in FIG. 5, a top ring 1 has an annular retaining portion 1*a* extending along its outer circumferential edge and projecting downwardly from the lower surface thereof. The annular retaining portion 1*a* and the lower surface of the top ring 1 jointly define a space for holding a semiconductor wafer 4 therein. That is, the lower end surface of the top ring 1 holds the upper surface of the semiconductor wafer 4, and the retaining portion 1*a* retains the outer circumferential edge of the semiconductor wafer 4 to prevent the semiconductor wafer 4 from being disengaged from the top ring 1. A presser ring 3A is vertically movably disposed around the top ring 1.

The presser ring 3A is corotatably, but vertically movably, coupled to the top ring 1 by keys 18. The presser ring 3A is rotatably supported by a bearing 19 which is mounted on a bearing holder 20. The bearing holder 20 is connected by vertical shafts 21 to a plurality of (three in this embodiment) circumferentially spaced presser ring air cylinders 23. The presser ring air cylinders 22 are secured to a lower surface of the top ring head 9. Other details of the polishing apparatus shown in FIG. 5 are identical to those of the polishing apparatus shown in FIG. 1 according to the first embodiment.

The polishing apparatus shown in FIG. 5 has a tilt suppressing mechanism 70 for holding the top ring 1 substantially angularly stabilized within the presser ring 3A to prevent the top ring 1 from being excessively tilted. The tilt suppressing mechanism 70 preferably comprises a resilient member such as an O ring of rubber or the like as the top ring 1 and the presser ring 3A are rotatable. In the third embodiment, the presser ring 3A may be nonrotatable, i.e., stationary, and only the top ring 1 may be rotatable. In such a modification, the tilt suppressing mechanism 70 preferably comprises a plurality of rollers as shown in FIG. 2.

Figure 6:
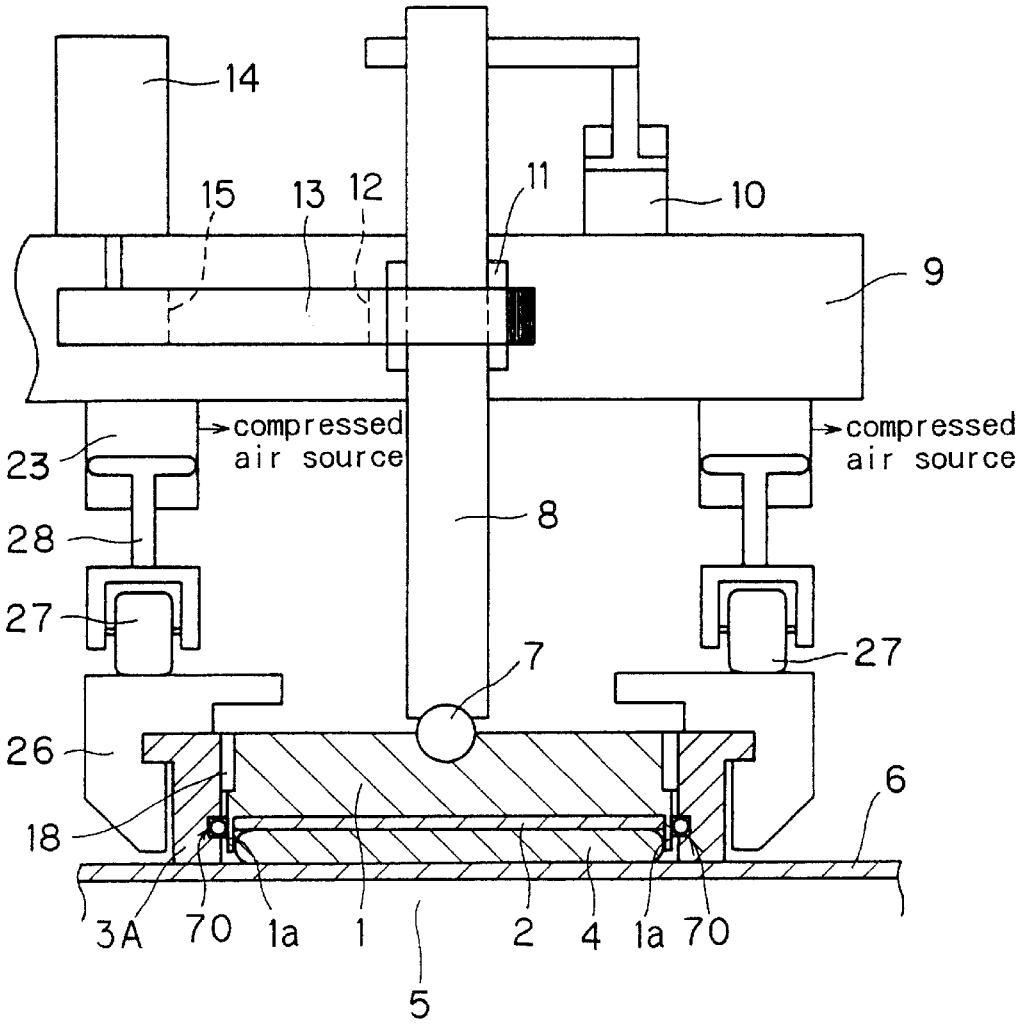
FIG. 6 is a vertical cross-sectional view of a polishing apparatus according to a fourth embodiment of the present invention.

FIG. 6 shows a polishing apparatus according to a fourth embodiment of the present invention. As shown in FIG. 6, a top ring 1 has an annular retaining portion 1*a* extending along its outer circumferential edge and projecting downwardly from the lower surface thereof. The semiconductor wafer 4 is held by the lower end surface of the top ring 1 and the retaining portion 1*a* and is prevented from being disengaged from the top ring 1. A presser ring 3A is vertically movably disposed around the top ring 1. The presser ring 3A is held by a presser ring holder 26 that is pressed by a plurality of rollers 27. The rollers 27 are coupled by respective shafts 28 to presser ring air cylinders 23 fixedly secured to a lower surface of a top ring head 9. The presser ring 3A is vertically movable with respect to the top ring 1 and rotatable in unison with the top ring 1 by keys 18. Other details of the polishing apparatus shown in FIG. 6 are identical to those of the polishing apparatus shown in FIG. 4 according to the second embodiment.

The polishing apparatus shown in FIG. 6 has a tilt suppressing mechanism 70 for holding the top ring 1 substantially angularly stabilized within the presser ring 3A to prevent the top ring 1 from being excessively tilted.

Figure 7A:
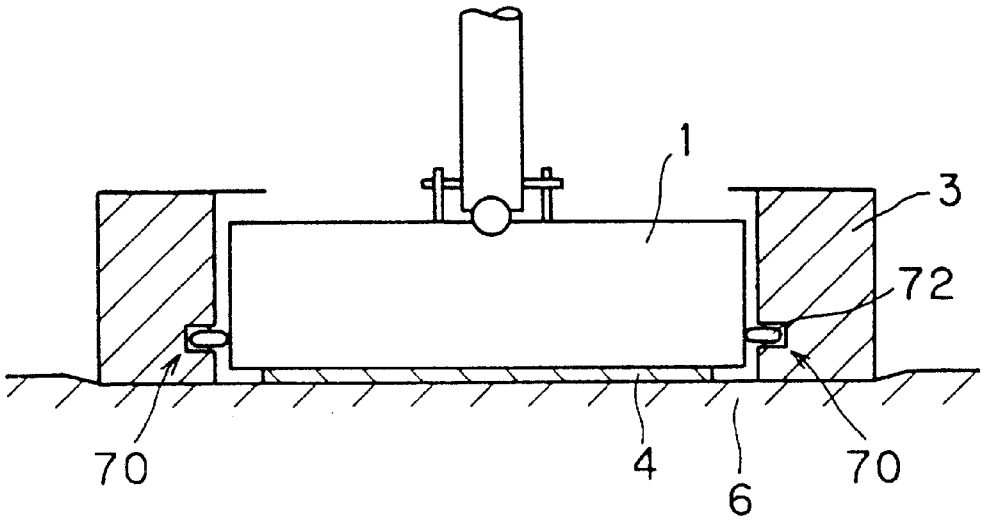
FIG. 7A is a vertical cross-sectional view of a polishing apparatus according to a fifth embodiment of the present invention.
Figure 7B:
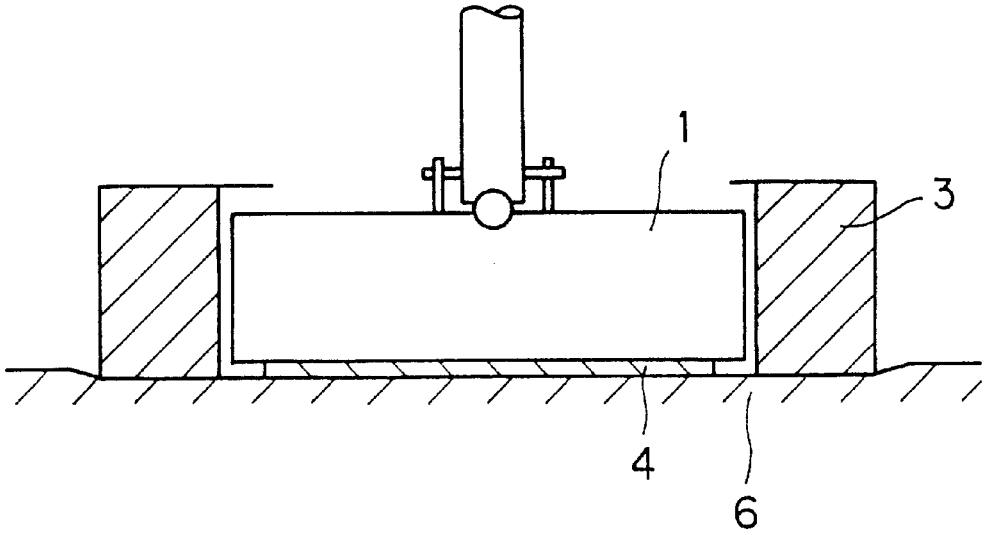
FIG. 7B is a vertical cross-sectional view of a polishing apparatus which is similar to the polishing apparatus shown in FIG. 7A, but is free of a tilt suppressing mechanism for preventing a top ring from being excessively tilted.
Figure 8:
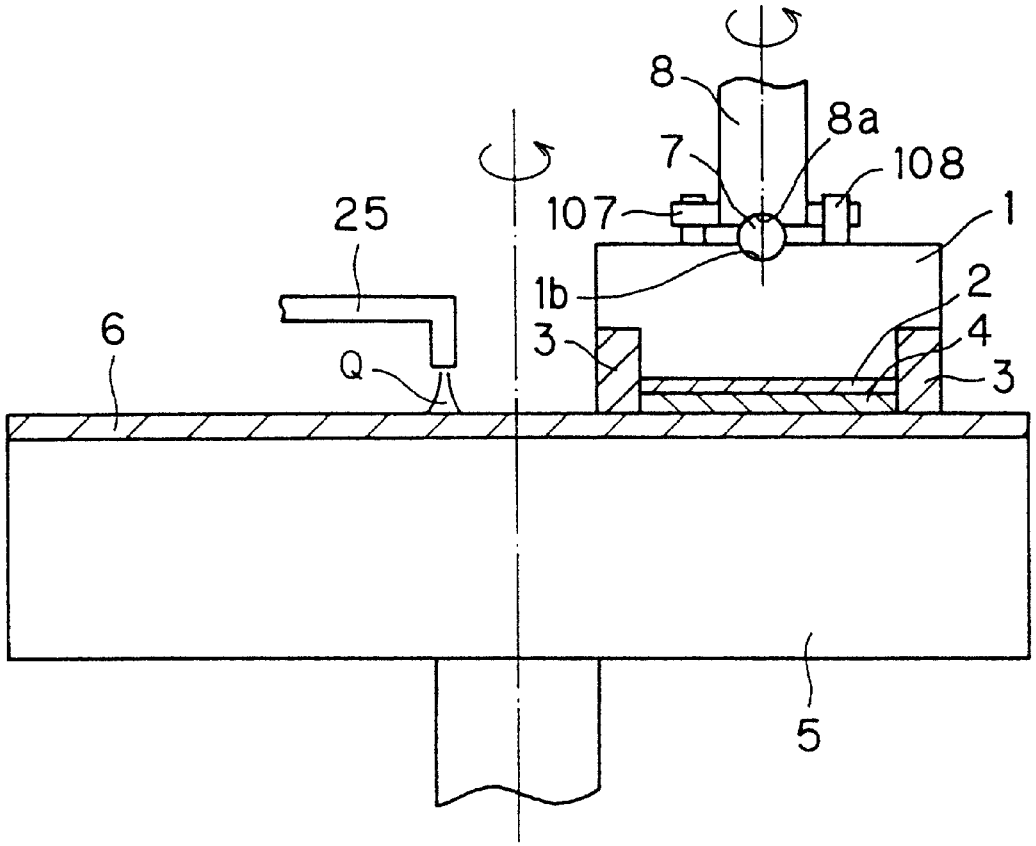
FIG. 8 is a vertical cross-sectional view of a conventional polishing apparatus.
Figure 9:
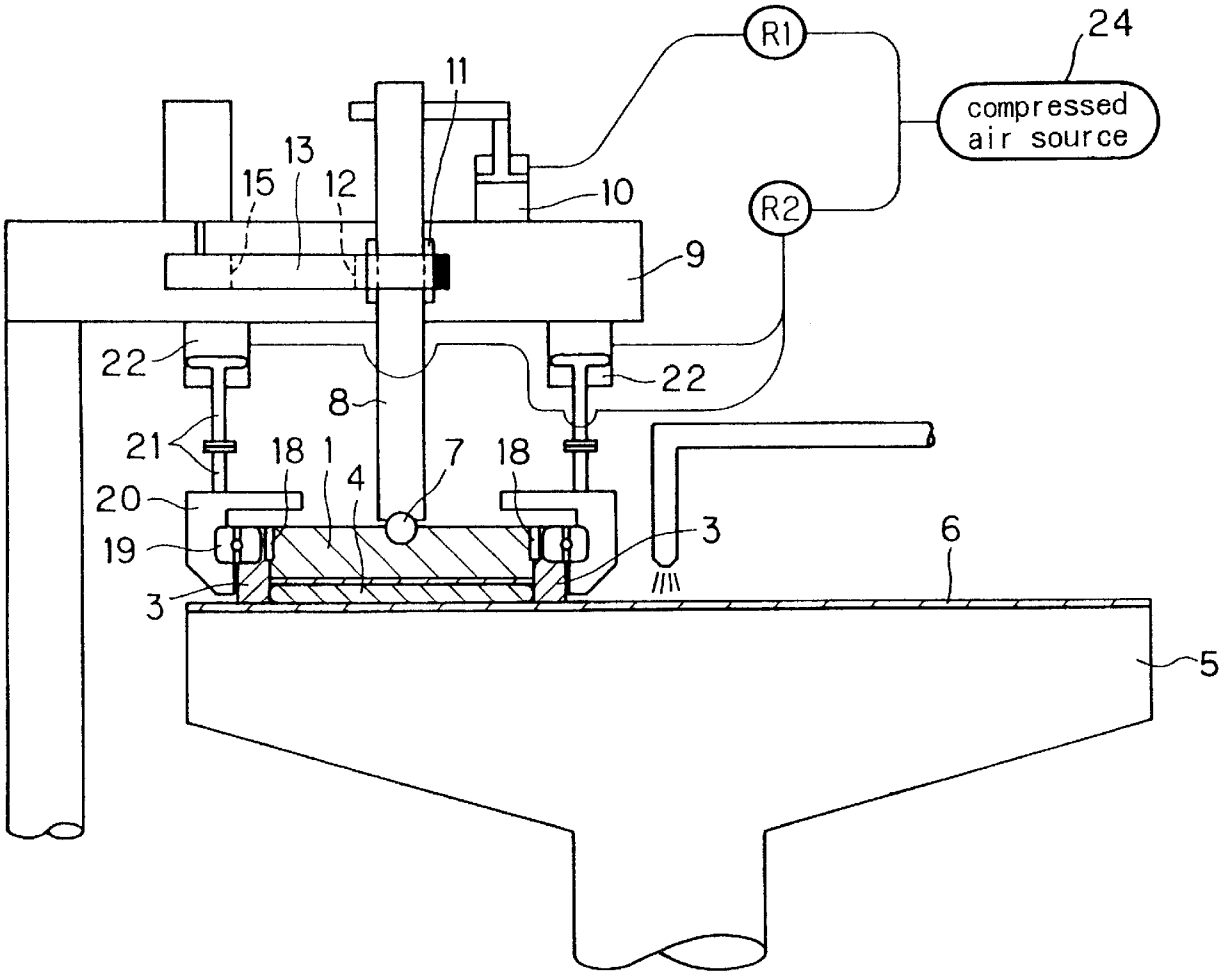
FIG. 9 is a vertical cross-sectional view of a polishing apparatus which has been proposed by the applicant of the present invention.
Figure 10:
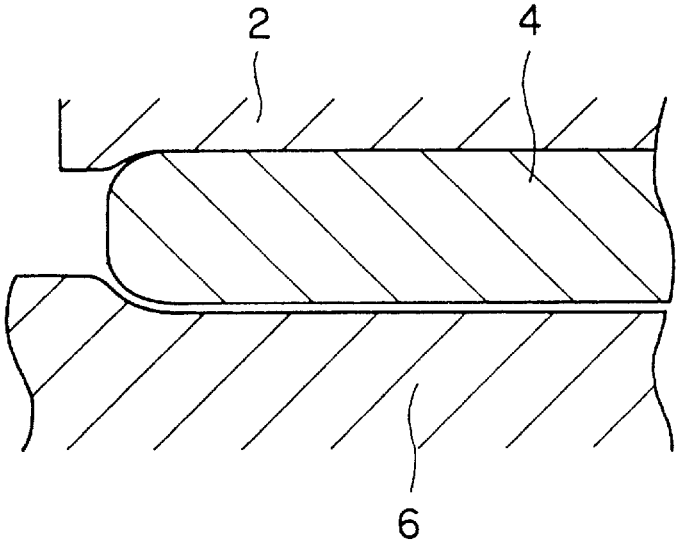
FIG. 10 is an enlarged fragmentary vertical cross-sectional view showing the states of a semiconductor wafer, a polishing cloth and an elastic pad while the semiconductor wafer is being polished by a conventional polishing apparatus.
Figure 11:
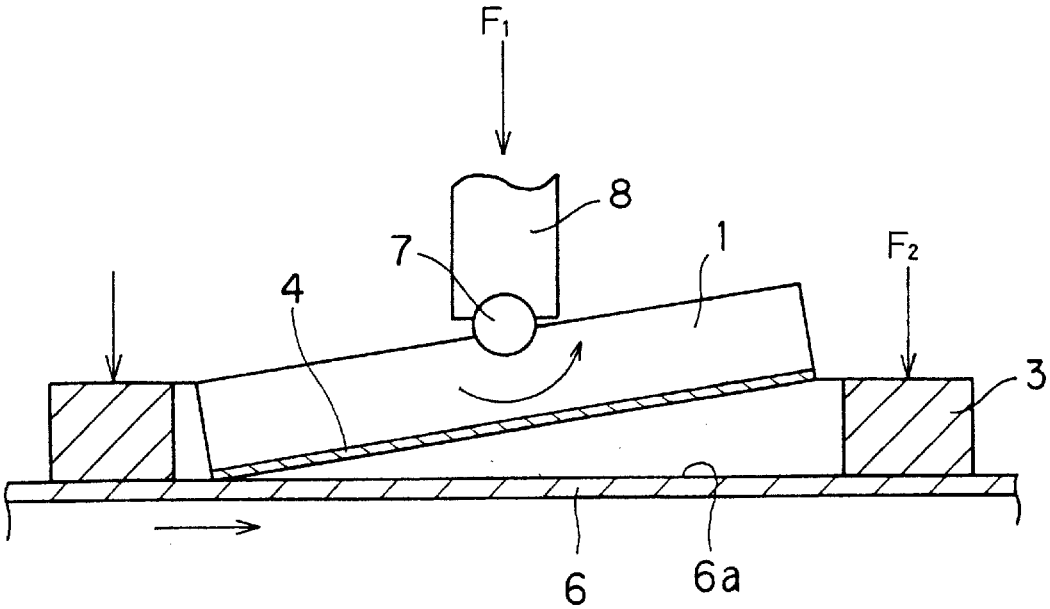
FIG. 11 is an enlarged vertical cross-sectional view showing the manner in which the top ring is tilted in a polishing process.

FIG. 7A illustrates a polishing apparatus according to a fifth embodiment of the present invention. FIG. 7B shows a polishing apparatus which is similar to the polishing apparatus shown in FIG. 7A, but is free of a tilt suppressing mechanism for preventing a top ring from being excessively tilted. In FIG. 7B, a retainer ring 3 is held against an polishing cloth 6 independently of a top ring 1 which holds a semiconductor wafer 4 to be polished. The retainer ring 3 presses the polishing cloth 6 around the semiconductor wafer 4 by its own weight for thereby preventing a step from being created between the surface of the polishing cloth 6 contacting the semiconductor wafer 4 and the surface of the polishing cloth 6 surrounding the semiconductor wafer 4. Since the top ring 1 and the retainer ring 3 are independent with each other, when the top ring 1 is tilted, the top ring 1 is not held by the retainer ring 3, and may be tilted excessively out of parallelism with the surface of the polishing cloth 6. On the other hand, the polishing apparatus shown in FIG. 7A has a tilt suppressing mechanism 70 comprising a plurality of resilient rollers 72 rotatably supported by the retainer ring 3 and held in rolling engagement with the top ring 1 for preventing the top ring 1 from being excessively tilted in the retainer ring 3.

In each of the above embodiments, the workpiece to be polished by the polishing apparatus has been described as a semiconductor wafer. However, the polishing apparatus according to the present invention may be used to polish other workpieces including a glass product, a liquid crystal panel, a ceramic product, etc. While the top ring 1, the retainer ring 3 and the presser ring 3A are pressed by air cylinders in the illustrated embodiments, they may be pressed by hydraulic cylinders. Alternatively, the top ring 1, the retainer ring 3 and the presser ring 3A may be pressed by electrical devices such as piezoelectric devices or electromagnetic devices rather than mechanical devices.

Although the tilt suppressing mechanism is mounted on the retainer ring or the presser ring in each of the above embodiments, the tilt suppressing mechanism may be mounted on the top ring.

With the arrangements of the present invention, as described above, the top ring which holds the workpiece to be polished is prevented from being excessively tilted and hence developing nonuniform pressure distribution, and is capable of applying a uniform pressure over the entire surface of the workpiece for polishing the entire surface of the workpiece to a flat mirror finish. Consequently, according to the present invention, when the polishing apparatus is used in the fabrication of semiconductor wafers, the semiconductor wafers can be polished to a flat mirror finish over their entire surfaces including outer peripheral edges thereof. Therefore, all portions, including outer peripheral edges, of the semiconductor wafers thus polished can be used as products, and yields of the semiconductor device can be increased.

Although certain preferred embodiments of the present invention have been shown and described in detail, it should be understood that various changes and modifications may be made therein without departing from the scope of the appended claims.

What is claimed is:

1. A polishing apparatus for polishing a workpiece, comprising:

a turntable with a polishing cloth mounted on an upper surface thereof;

a top ring for holding a workpiece and pressing the workpiece against said polishing cloth under a first pressing force to polish the workpiece;

a retainer ring positioned outwardly of said top ring for retaining said workpiece on said top ring, said retainer ring being vertically movable relative to said top ring; and a stabilizing mechanism disposed between an inner circumferential surface of said retainer ring and an outer circumferential surface of said top ring, for holding said top ring substantially stabilized within said retainer ring.

2. A polishing apparatus according to claim 1, wherein said stabilizing mechanism holds said top ring angularly stabilized and prevents said top ring from being excessively tilted within said retainer ring.

3. A polishing apparatus according to claim 1, further comprising:

a pressing mechanism for pressing said retainer ring against said polishing cloth under a second pressing force.

4. A polishing apparatus according to claim 1, wherein said stabilizing mechanism comprises a plurality of rollers rotatably supported on said inner circumferential surface of said retainer ring and held in rolling contact with said outer circumferential surface of said top ring for preventing said top ring from being excessively tilted within said retainer ring.

5. A polishing apparatus according to claim 1, wherein said stabilizing mechanism comprises a resilient member supported on said inner circumferential surface of said retainer ring and held in contact with said outer circumferential surface of said top ring for preventing said top ring from being excessively tilted within said retainer ring.

6. A polishing apparatus for polishing a workpiece, said apparatus comprising:

a turntable with a polishing cloth mounted on an upper surface thereof;

a top ring for holding a workpiece and pressing the workpiece against said polishing cloth under a first pressing force to polish the workpiece, said top ring having a retaining portion for retaining an outer circumferential edge of the workpiece;

a presser ring positioned outwardly of said retaining portion, said presser ring being vertically movable relative to said top ring; and a stabilizing mechanism disposed between an inner circumferential surface of said presser ring and an outer circumferential surface of said top ring, for holding said top ring substantially stabilized within said presser ring.

7. A polishing apparatus according to claim 6, wherein said stabilizing mechanism holds said top ring angularly stabilized and prevents said top ring from being excessively tilted within said presser ring.

8. A polishing apparatus according to claim 6, further comprising:

a pressing mechanism for pressing said presser ring against said polishing cloth under a second pressing force.

9. A polishing apparatus according to claim 6, wherein said stabilizing mechanism comprises a plurality of rollers rotatably supported on said inner circumferential surface of said presser ring and held in rolling contact with said outer circumferential surface of said top ring for preventing said top ring from being excessively tilted within said presser ring.

10. A polishing apparatus according to claim 6, wherein said stabilizing mechanism comprises a resilient member supported on said inner circumferential surface of said presser ring and held in contact with said outer circumferential surface of said top ring for preventing said top ring from being excessively tilted within said presser ring.

11. A polishing apparatus for polishing a workpiece, comprising:

a turntable with a polishing surface;

a top ring for holding a workpiece and pressing the workpiece against said polishing surface under a first pressing force to polish the workpiece;

a retainer ring positioned outwardly of said top ring for retaining said workpiece on said top ring, said retainer ring being vertically movable relative to said top ring; and a stabilizing mechanism disposed between an inner circumferential surface of said retainer ring and an outer circumferential surface of said top ring, for holding said top ring substantially stabilized within said retainer ring.

12. A polishing apparatus for polishing a workpiece, said apparatus comprising:

a turntable with a polishing surface;

a top ring for holding a workpiece and pressing the workpiece against said polishing surface under a first pressing force to polish the workpiece, said top ring having a retaining portion for retaining an outer circumferential edge of the workpiece;

a presser ring positioned outwardly of said retaining portion, said presser ring being vertically movable relative to said top ring; and a stabilizing mechanism disposed between an inner circumferential surface of said presser ring and an outer circumferential surface of said top ring, for holding said top ring substantially stabilized within said presser ring.

* * * * *